US006926259B1

(12) United States Patent
Roodenburg et al.

(10) Patent No.: US 6,926,259 B1
(45) Date of Patent: Aug. 9, 2005

(54) HOIST SYSTEM

(75) Inventors: Joop Roodenburg, Delft (NL); Adriaan Jan Rodenburg, Rotterdam (NL)

(73) Assignee: Itrec B.V., (NL)

( * ) Notice: Subject to any disclaimer, the term of this patent is extended or adjusted under 35 U.S.C. 154(b) by 130 days.

(21) Appl. No.: 10/387,282

(22) Filed: Mar. 12, 2003

(51) Int. Cl.[7] ..... B66D 1/00
(52) U.S. Cl. ..... 254/277; 254/286; 254/338; 254/394
(58) Field of Search ..... 254/277, 285, 254/900, 377, 290, 291, 387, 286, 292, 337, 254/338, 393, 394

(56) References Cited

U.S. PATENT DOCUMENTS 3,684,244 A * 8/1972 Houck ..... 254/276
3,717,205 A * 2/1973 Wilderman ..... 173/147
3,791,628 A * 2/1974 Burns et al. ..... 254/277
3,917,230 A * 11/1975 Barron ..... 254/270
4,423,994 A * 1/1984 Schefers et al. ..... 414/22.68
4,671,365 A * 6/1987 Back ..... 173/28
4,867,418 A * 9/1989 Daniels ..... 254/277
5,351,767 A * 10/1994 Stogner et al. ..... 175/162
5,894,895 A * 4/1999 Welsh ..... 175/5
6,595,494 B1 * 7/2003 Roodenburg et al. ..... 254/277

* cited by examiner

*Primary Examiner*—Emmanuel Marcelo
(74) *Attorney, Agent, or Firm*—Buskop Law Group, P.C.; Wendy Buskop

(57) ABSTRACT

The invention is a hoist system for use on a drilling rig made of a tubular mast with a front, back, and top side, a splittable block connected to the mast top side, a trolley with a trolley top and bottom side, wherein the trolley's top side is connected to the splittable block and wherein the trolley is removably secured on the mast's front side, a gripper connected to the trolley bottom side for gripping a load, a hoist cable passing through the splittable block and connected on one end to a hoist cable winch, and a hoist cable winch adapted to pull the hoist cable over the mast top side and through the splittable block to move the trolley relative to the tubular mast and lift the load.

66 Claims, 13 Drawing Sheets

37

18
32
166
162
164
160
44
38
46
48
40
42
22
28
64

37
18
32
44
38
42
40
48
46
22
28
64

HOIST SYSTEM

The present application claims priority to Pending patent application Ser. No. 09/807,078 filed in the U.S. Patent and Trademark Office on Jul. 2, 2001.

FIELD OF THE INVENTION

The present invention relates to a hoist system contained inside a tower that minimizes the energy consumption and operating cost of lifting operations.

BACKGROUND OF THE INVENTION

Hoist systems, in the prior art, are used in the offshore industry in the form of drilling derricks on, for example, drilling vessels. When, in use, a drill string is attached to the bottom side of a trolley, also known as a traveling block. The trolley runs on a separate track inside the derrick. These tracks must be supported in order to avoid unwanted movements of the running trolley; however, due to constructional limitations, a certain movement remains. Since the trolley is usually located inside the derrick, access to the running trolley is severely limited. This decreases the useful work that can be done with the derrick.

It is therefore advantageous for running tracks to be located on the outside of the load carrying construction. This outside location would increase the useful work that can be done. The running tracks can be integrated into the load carrying structure to obtain a satisfactory level of stiffness without adding to much extra weight to the construction.

It is therefore advantageous to use a tube or sleeve type construction as hoist system and build the running tracks on one side of the tube or sleeve. This type of construction would not have the afore-mentioned draw backs. The current application has a hoist system in the form of a tube or sleeve.

According to the prior art, it is customary for a hoisting cable to be attached to a fixed point at one end. The other end of the hoisting cable is then wound around a winch. If this winch breaks down, it is no longer possible to work with the device. The design of the afore-mentioned winch must be relatively large and costly to meet with all the required demands.

A major factor in the wearing of the hoist cable is that repeated bending of the wire in the same places. In order to increase the service life of the cable, the cable has to be shifted often. Hoist systems in the prior art use a procedure known as the "slip & cut". This procedure requires considerable time and is also dangerous to the workers.

An object of this invention to provide a hoist system in which an increased level of redundancy is provided. Another object of this invention to provide means with which the time consuming and dangerous "slip & cut" procedure can be avoided altogether. Another object of this invention is to provide a hoist system with relatively inexpensive winches in order to decrease the building and operating cost of the hoist system.

An advantage of the invention is that hoisting means can be provided with two winches, each end of the hoisting cable being wound onto a separate winch. By winding the two ends onto a separate winch, it is possible to achieve the same cable speed at a relatively low speed of revolution of the winches. By using two winches the cable can be shifted automatically a distance from one winch to the other winch. This method effectively replaces the "slip & cut" procedure.

This alternative method takes considerably less time and can be performed completely automatic reducing the chance of personal injuries.

Moreover, by adding the second winch, redundancy is provided in the system. If one of the winches fails, the hoist system is still usable and work can continue with a single winch.

The winches can be driven by a plurality of relatively small motors; therefore, twice as many sides of the winches can be used to attach the motor on the winch. These winch motors can be relatively small. For example, it is possible to equip the winches on both sides with electric motors that engage with a pinion in a toothed wheel of the winch. The first advantage of this is that such electric motors are commercially available. For the use in the hoist system, it is not necessary to develop a special and expensive hoisting winch. The second advantage is that the relatively small motors have a low internal inertia. The low inertia means that when the direction of rotation of the winch is reversed less energy and time are lost during the reversal.

In the case of a hoist system according to the prior art of the type mentioned in the preamble, finding the optimum compromise between speed and power is a known problem. The hoisting cable is guided in such a way over the cable blocks in the mast and on the trolley that several cable parts extend between the mast and the trolley. In this case the more wire parts are present between the mast and the trolley; the greater the load that can be lifted with the hoist system if the hoisting winch remains unchanged. However, the more wire parts are present between the mast and the trolley, the lower the speed at which the trolley can be moved relative to the mast when the maximal speed of the winch stays the same.

In order to find a good compromise between speed and lifting power, it is generally decided to provide the hoist system with relatively heavy winches. The heavy winches are designed to ensure that the rapid movement of the trolley up and down can be met in every case. This also means, however, that a substantial part of the lifting power is not being utilized for a substantial part of the time. In other words, the device is actually provided with winches that are too heavy—and therefore too expensive—to be able to reach sufficient speed occasionally.

Another object of the present invention to provide a hoist system of the type mentioned in the preamble. On the one hand, a relatively heavy load can be lifted and, on the other hand, a relatively light load can be operated at a relatively high speed. This type of design means winches and motors are relatively light and cheap.

The object of the current invention is achieved by the fact that the hoisting cable is guided over loose pulleys that can be moved between a first position, in which the loose pulleys are connected to the mast, and a second position, in which the loose pulleys are connected to the trolley.

The effect of this measure is that the number of wire parts between the mast and the trolley can be set as desired. When the loose pulleys are attached to the mast, few wire parts will extend between the mast and the trolley, and a relatively low weight can be lifted with a relatively high speed. When the loose pulleys are attached to the trolley, a relatively large number of wire parts will extend between the mast and the trolley, and the trolley can be moved at a relatively low speed relative to the mast with a relatively large load. Since the hoisting cable is guided over the pulleys and the pulleys can be attached as desired to the mast or to the trolley, the hoisting cable does not have to be reeved again. The desired number of wire parts can be set in a relatively short time.

According to the invention, it is possible for the loose pulleys to be attached symmetrically relative to the center of the mast. This orientation of the attachments ensures that the forces exerted upon the cables are also transmitted symmetrically to a mast. The symmetry means that no additional bending loads are exerted upon the mast limiting the necessary weight of the mast.

According to the invention, it is also possible for the loose pulleys to be accommodated in a housing. Locking elements can be added for fixing the pulleys on the trolley. The loose pulleys are pulled automatically into their first position, in contact with the mast, by tension in the hoisting cable. It is therefore sufficient to provide the bottom side of the pulleys with locking elements. The use of a hydraulic actuation device means that the locking pins can be remotely controlled.

A relatively new technology is casing drilling. Casing drilling towers and drilling derricks need some special features such as openings in travelling blocks and crown blocks at the location of the firing line. In drilling derricks in the prior art, these special features can only be installed at high cost. An object of the present invention is to provide a hoist system of the type mentioned in the preamble by in which casing drilling operations can be performed without additional costs and with increased safety.

SUMMARY OF THE INVENTION

The current invention overcomes the prior art by providing a hoist system with a tubular mast, a splittable block connected to the top side of the mast, and trolley connected to the splittable block. The trolley is removably secured on the front side of the mast. The hoist system also has a gripper connected to the bottom side of the trolley for gripping a load, a hoist cable guided through the splittable block, and a winch adapted to pull the hoisting cable over the top side of the mast and through the splittable block to move the trolley relative to the tubular mast.

The hoist system provides also a safe and cost effective platform to perform casing drilling operations.

The invention is also a method for quickly modifying a hoist system from heavy load lifting to light load lifting by disconnecting the heavy load from the gripper and hoisting the trolley to a first position on the mast. The method ends by disengaging a portion of the loose pulleys from the trolley, picking up a lighter load, and resuming the hoist system operation.

The invention is also a method to slip the hoist cable of the hoist system by stopping the hoist system lifting operations, paying out the hoist cable with the winch, winding the hoist cable with the second winch, thereby transferring the hoist cable from the winch to the second winch, and, finally, restarting hoist system lifting operations.

The invention is also a method for quickly modifying a hoist system from light load lifting to heavy load lifting by disconnecting the light load from the gripper and hoisting the trolley to a first position on the mast. The method ends by disengaging a portion of the loose pulleys from the trolley, picking up a heavier load, and resuming the hoist system operation

BRIEF DESCRIPTION OF THE DRAWINGS

The present invention will be described further with reference to the appended drawings, in which.

The present invention is detailed below with reference to the listed FIGS.

DETAILED DESCRIPTION OF THE PREFERRED EMBODIMENTS

Before explaining the present invention in detail, it is to be understood that the invention is not limited to the particular embodiments and that it can be practiced or carried out in various ways.

A novel feature of the invention is that the hoist system can be used to lift a heavy load and then a light load, in sequence, quickly, safely and efficiently. Similarly, the invention can be used to lift a plurality of light loads and then quickly modified to lift a plurality of heavy loads. The modifications can be done quickly, easily, and safely at sea, without the hoist system needing to be returned to land for retrofitting.

Figure 1:
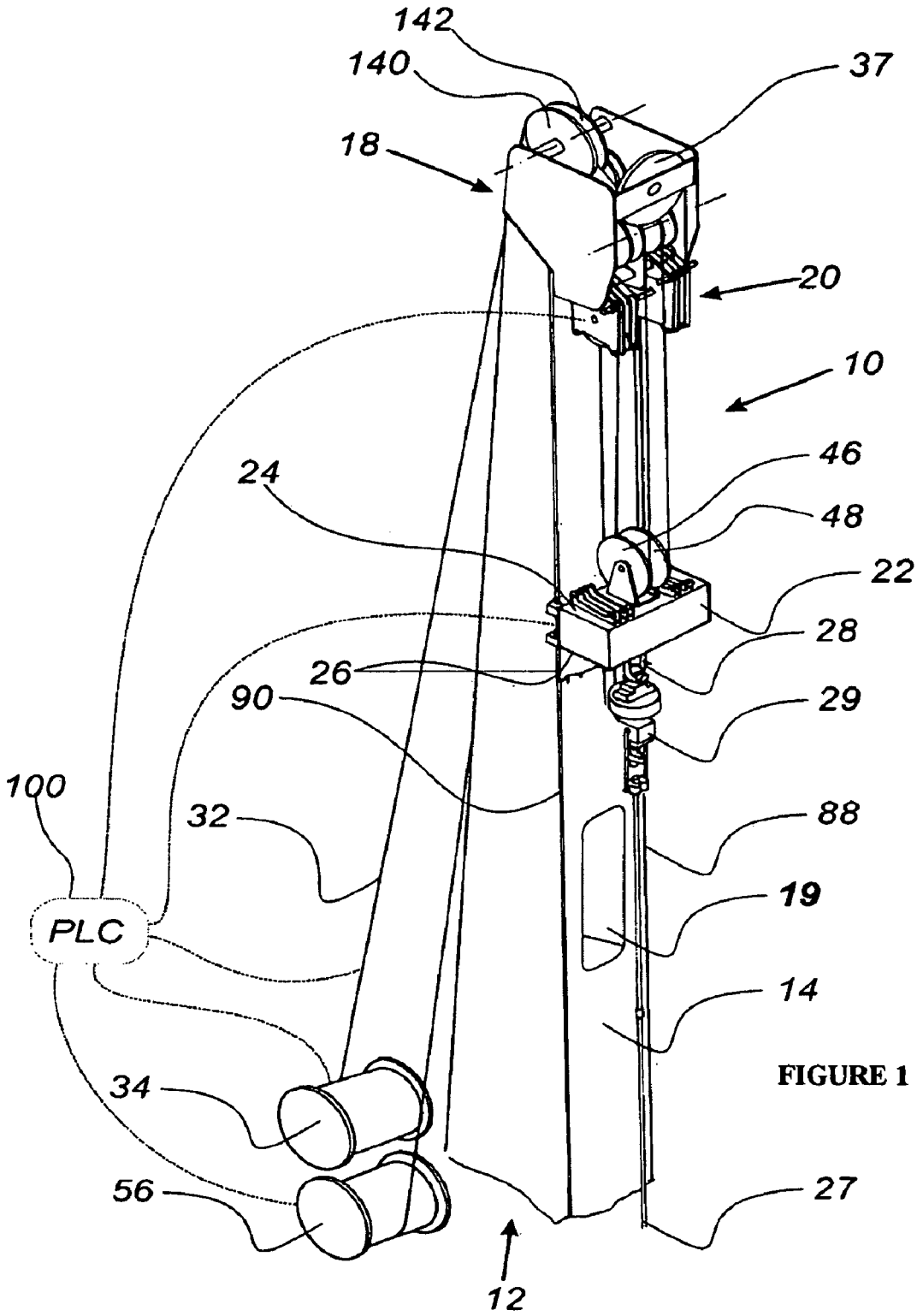
FIG. 1 shows the hoist system according to the present invention.

FIG. 1 shows the hoist system 10 according to the present invention. The hoist system 10 comprises a tubular mast 12. In the description below the term tubular mast will always be used, but it must be understood that any other suitable device, such as, for example, a tower, could also be used. The system is controlled by a control system 100.

Figure 12:
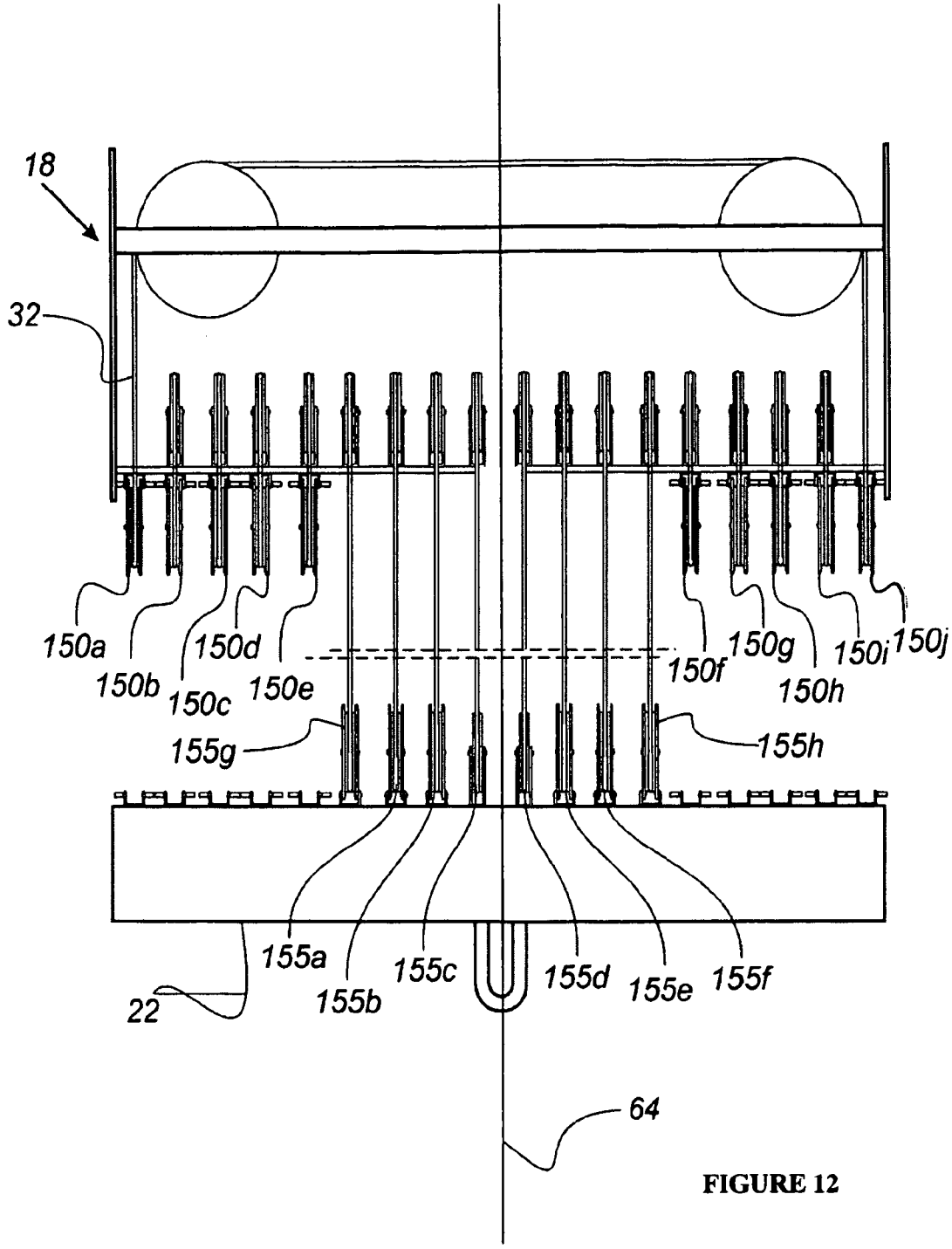
FIG. 12 shows a side view of an embodiment of a splittable block with eight fixed pulleys.

The top side of the tubular mast 12 is formed by a mast topside 18. A large number of cable pulleys are fixed to the topside 18. FIG. 12 examples an embodiment wherein ten loose pulleys 150*a*, 150*b*, 150*c*, 150*d*, 150*e*, 150*f*, 150*g*, 150*h*, 150*i*, and 150*j* are attached the mast top side 18 and eight fixed pulleys 155*a*, 155*b*, 155*c*, 155*d*, 155*e*, 155*f*, 155*g*, and 155*h* are attached to the trolley 22.

Furthermore, a return fixed pulley 37 is fixed on the front side of the mast topside 18, the axis of the fixed return pulley 37 being substantially perpendicular to the axis of the loose and fixed pulleys 38, 40, 42, 44, 46, 48. Also return pulleys 140, 142 can be seen which guide the hoist wire 32 from the mast topside 18 to winches 34, 56.

The hoist system 10 further comprises a trolley 22. This trolley 22 can move along a guide in the form of rails 88 and 90 relative to the tubular mast 12. Trolley 22 comprises a trolley top side 24 and a trolley bottom side 26. On the trolley bottom side 26, trolley 22 is provided with a gripper or hook 28, or some other suitable means, to which a load to be hoisted can be attached. FIG. 1 shows the case in which a top drive 29 with a drill string 27 fixed below it is attached to the gripper 28. On the trolley top side 24, trolley 22 is provided with two fixed cable pulleys 46, 48. The trolley top side 24 is connected to the splittable block 20 by means of hoist cable 32 which runs over return pulleys 140, 142 to the splittable block pulleys and the pulleys located on the trolley topside 24. Trolley 22 is removably secured on the mast front side 14.

Returning to FIG. 3, in addition to the above mentioned cable pulleys 140, 142, four "loose pulleys" 38, 40, 42 and 44 are also present in the hoist system 10. Also visible are fixed masthead pulleys 160, 162, 164, 166. Returning to FIG. 2 these loose pulleys 38, 40, 42 and 44 may be attached as desired to the mast top side 18 or to the trolley 22. The coupling of the loose pulleys 38, 40, 42 and 44 to the mast top side 18 or to the trolley 22 is shown in detail in FIG. 3 through FIG. 9.

The advantage of the presence of the loose pulleys 38, 40, 42 and 44 is that the number of wire parts of the hoist cable 32 that extend between the mast top side 18 and the trolley 22 can be varied. If the loose pulleys 38, 40, 42 and 44 are attached to the mast top side 18, a limited number of wire parts will extend in the direction of the trolley 22. That means that, on the one hand, a relatively limited weight can be lifted with the aid of the hoist system, but, on the other hand, the trolley 22 can be moved relatively quickly in the direction of the mast top side 18. If the loose pulleys 38, 40, 42 and 44 are attached to the trolley 22, a relatively large number of wire parts will extend from the mast top side 18 in the direction of the trolley 22. That means that a relatively great weight can be lifted with the aid of the trolley 22, but that the trolley 22 will be moved at a relatively slow speed relative to the mast top side 18 with unchanged maximal winch speed. By distributing the number of loose pulleys 38, 40, 42 and 44 as desired over the mast top side 18 and the trolley 22, it is ensured that both the weight to be lifted with the hoist system and the speed at which the trolley 22 can be moved relative to the mast top side 18 are adjustable.

In the prior art a known problem is that a hoist system often has to be equipped with a relatively large drive, in order to be able to achieve a workable compromise between the maximum lifting power and the minimum speed to be achieved. This problem is solved by the "loose pulleys" according to the present invention. The combination of loose pulleys is called "splittable blocks".

In the hoist system 10 according to FIG. 1 the hoist cable 32 extends from a first hoist cable winch 34 in the direction of the mast top side 18. The hoisting winch is also known as a "draw works". The hoisting hoist cable 32 is subsequently guided back to a second hoisting winch 56. In the prior art, it is customary for an end section of the hoisting hoist cable 32 to be fixed at a fixed point, the other end being rolled up on a hoisting winch. Several advantages can be obtained by making use of two hoisting winches 34 and 56, as an alternative to using one winch as in the hoist system 10. In order to achieve a certain speed of trolley 22 relative to mast top side 18, the speed of rotation of the hoisting winches 34 and 56 can be kept twice as low compared to using one hoisting winch. One of the effects that can be obtained by keeping the speed of the hoisting winches 34 and 56 relatively low is that little wear will occur in the hoist cable 32.

Another advantage of using two winches is that the manual "slip & cut" procedure according to prior art is now no longer needed. The "slip & cut" procedure is needed to increase the service life of the hoisting cable. The procedure takes a considerably amount of time since it has to be done very regularly, manually and it not without danger. Also by using two winches the redundancy of the hoist system is increased. Should one of the two hoisting winches fail during use, work can continue using another hoisting winch. In the prior art the failure of a hoisting winch immediately means that the hoist system can no longer be used.

The hoisting winches 34 and 56 are preferably driven by electric motors 58, 60. When using two winches each side of each hoisting winch for example, 34 and 56 can be provided with such a motor doubling the number of sides to which a motor can be attached. That means each hoisting winch is driven by 2 electric motors. First, this has the advantage that the electric motors to be used can be kept relatively small, which means that these motors do not have to be designed specifically for the hoisting purposes, but will be in stock on the market. This in contrast to designs that are currently on the market which use large, custom made and therefore expensive motors. Secondly, the use of the relatively small motors has the effect that the internal inertia in the motors is kept low. That means that when the direction of rotation of the winches 34 are 56 is reversed the internal inertia of the drive elements themselves will not give rise to problems. This is especially an advantage when using the hoist system on a drilling rig and operating in the so called "active heave compensation" mode. In this mode the winches are used to compensate for the movement of the rig by continuously paying out or in cable.

The hoist system 10 according to the present invention can advantageously be used for numerous hoisting operations. The hoist system 10 is particularly advantageous when used in the case of drilling operations, from a vessel. The reason for this is that, particularly in the case of such drilling operations, in some parts of the drilling processes has to be possible for a very great hoisting force to be applied, and that in other parts of the drilling process the speed at which the trolley can move relative to the mast in the most important factor.

The tubular mast has dimensions of a height between 30 feet and 240 feet and a diameter between 3 feet and 30 feet. The tubular mast can also be secured to a floating vessel or a platform. Further, the tubular mast can have at least one opening in the front side or at least one opening in the back side.

The tubular mast has a central axis and the loose pulleys are attached symmetrically on the tubular mast relative to the central axis. Possible shapes for the tubular mast include rectangular, square, triangular, and other angular shapes. The tubular mast can be partially solid.

The hoist cable has a diameter ranging between 0.5 inches and 3 inches and is adapted to support a load of between 1 metric ton and 100 metric tons. The system can further include a control system for monitoring and driving the hoist cable, the winch, the splittable block, and the trolley.

Figure 2:
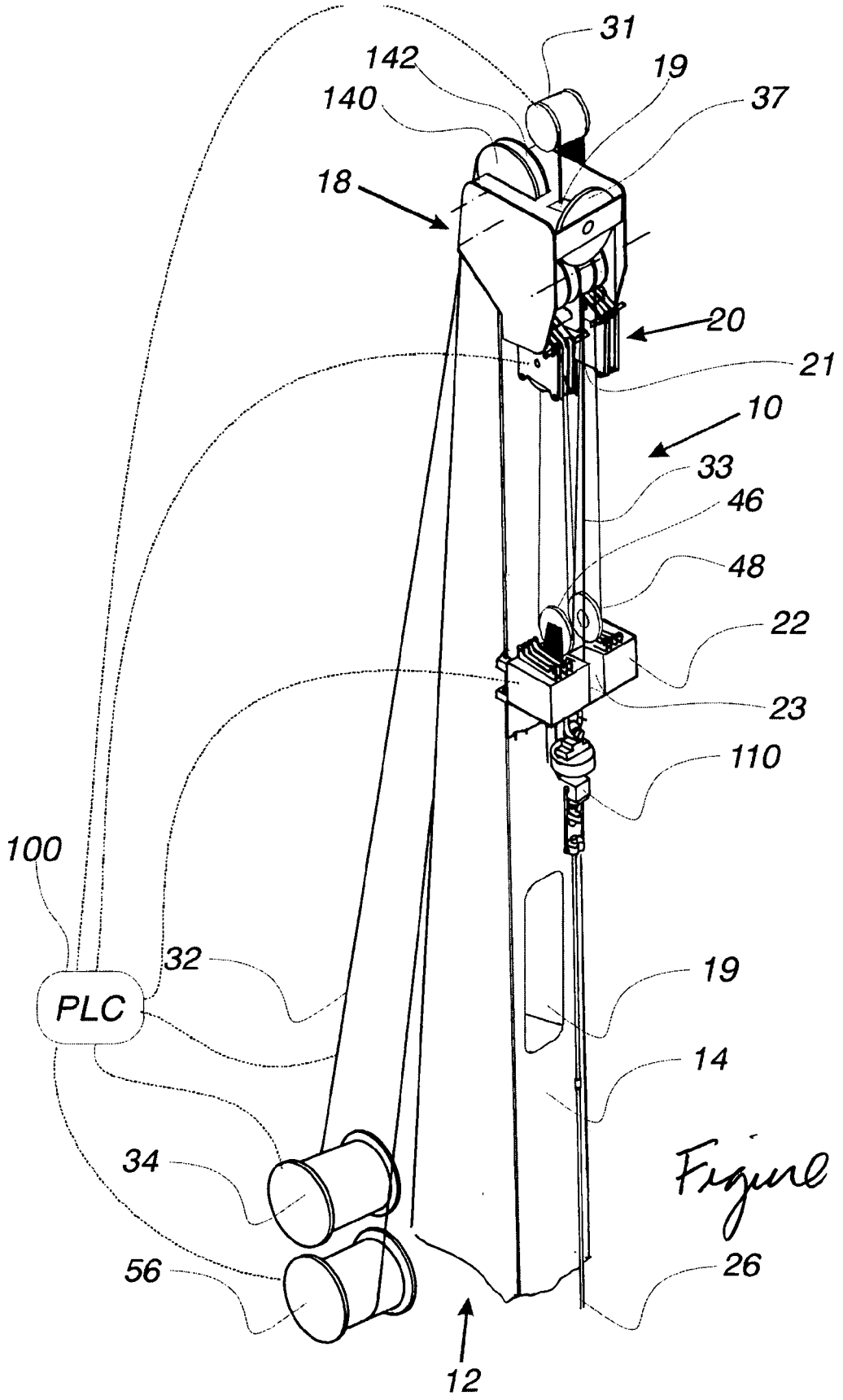
FIG. 2 shows the hoist system according to the present invention adapted for casing drilling.

FIG. 2 shows the hoist system 10 according to the present invention adapted for casing drilling. The hoist system 10 comprises a tubular mast 12 provided with a topside 18, a mast back side 16 and a mast front side 14, a splittable 20 block connected to the mast topside 18, a trolley 22 connected to the mast front side comprising a trolley topside 24 and a trolley bottom side 26. Trolley 22 is connected to the hoist cable winch 34 by hoist wire 32 passing through the splittable block 20 connected to the trolley and the mast top side 18. Hoist cable 32 is connected on a first end hoist cable 52 to the hoist cable winch 34 and one the second end can be attached to a fixed point. To adapt the hoist system for casing drilling operations masthead 18 is provided with mast opening 19. Opening 19 lying substantially around firing-line axis 13. Splittable block 20 is also provided with a splittable opening 21 which is aligned with mast opening 19. Trolley 10 is provided with trolley opening 23 which is aligned with splittable block opening 21. Running through the openings 19, 21, 23 is wire line 33. Wire line cable is connected to the wire winch 31 at a wire line first end 53 and on the other end to casing drilling equipment 110.

Figure 3:
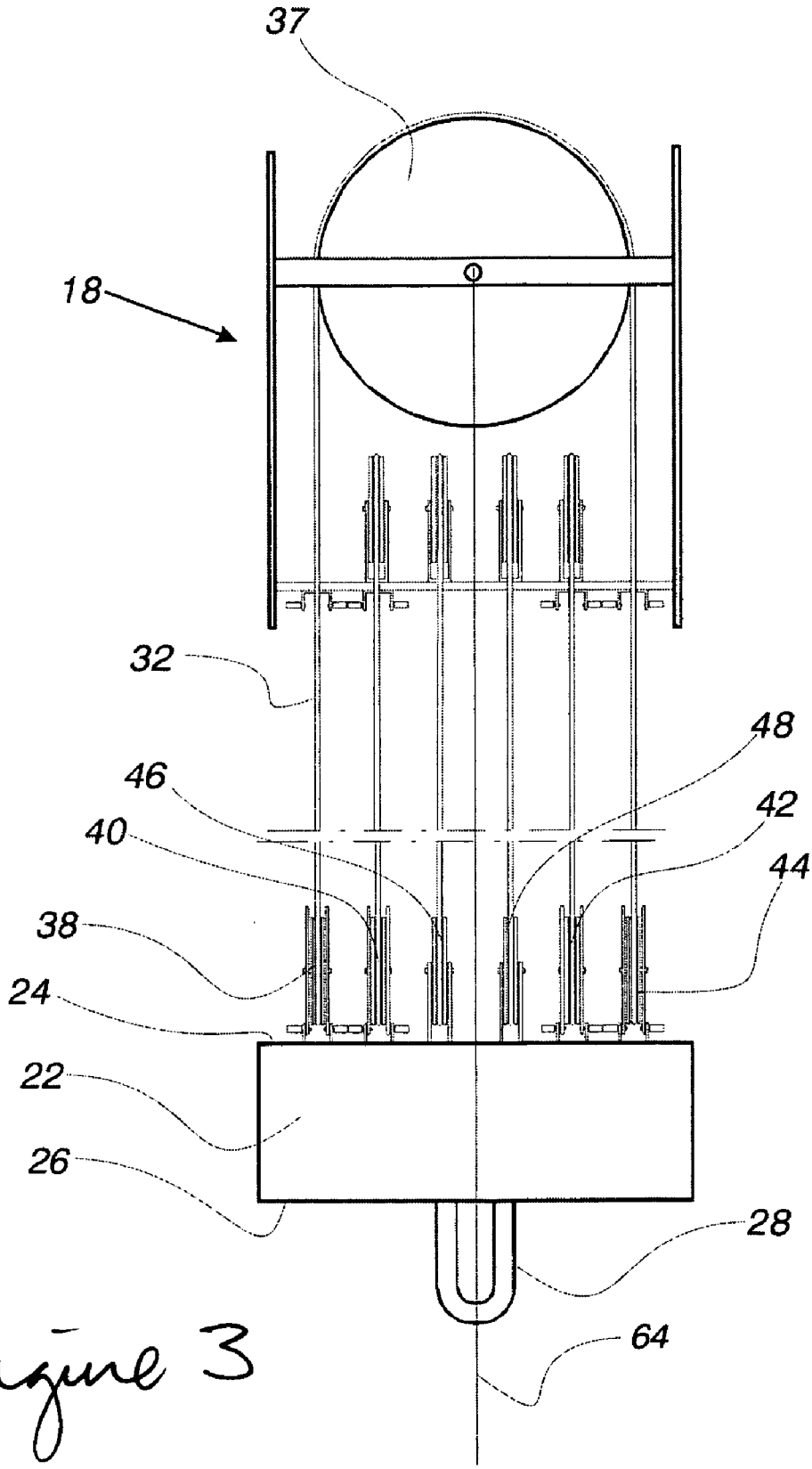
FIG. 3 shows the case where four loose pulleys are attached to the trolley.

FIG. 3 illustrates the case where four loose pulleys 38, 40, 42, 44 are attached to the trolley 10. It can be seen in FIG. 3 that four loose pulleys 38, 40, 42, 44 and two fixed pulleys 46, 48 are attached to the trolley 22. This means that twelve wire parts extend between the trolley 22 and the mast top side 18.

Figure 4:
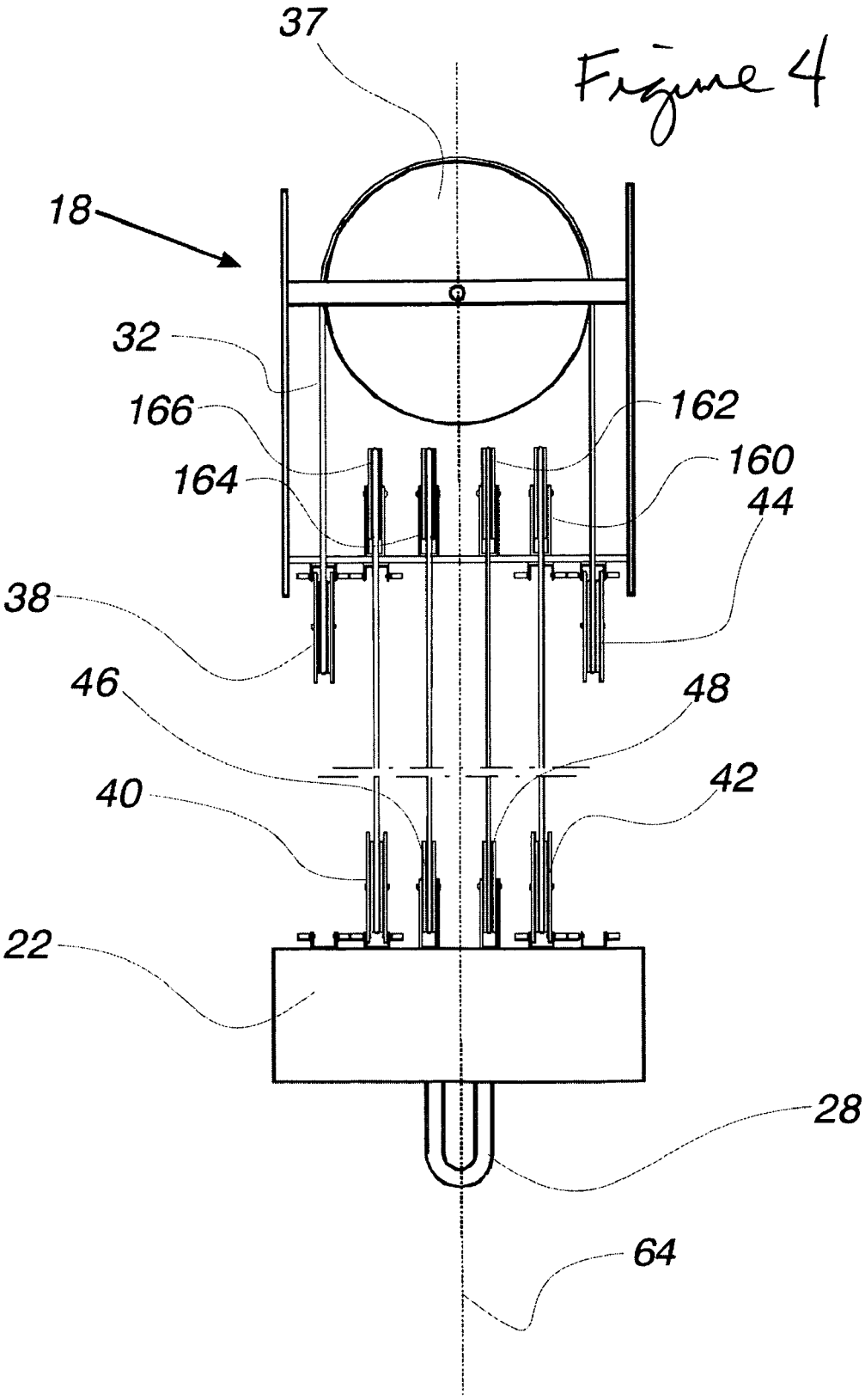
FIG. 4 shows the case where two loose pulleys are attached to the trolley and two loose pulleys are attached to the mast head.

FIG. 4 shows the case where two loose pulleys 38, 42 and are attached to the mast top side 18 and two loose pulleys 40, 44 and two fixed pulleys 46, 48 are attached to the trolley 22. In this case eight wire parts will extend between the mast top side 18 and the trolley 22. The central axis is reference numeral 64.

Figure 5:
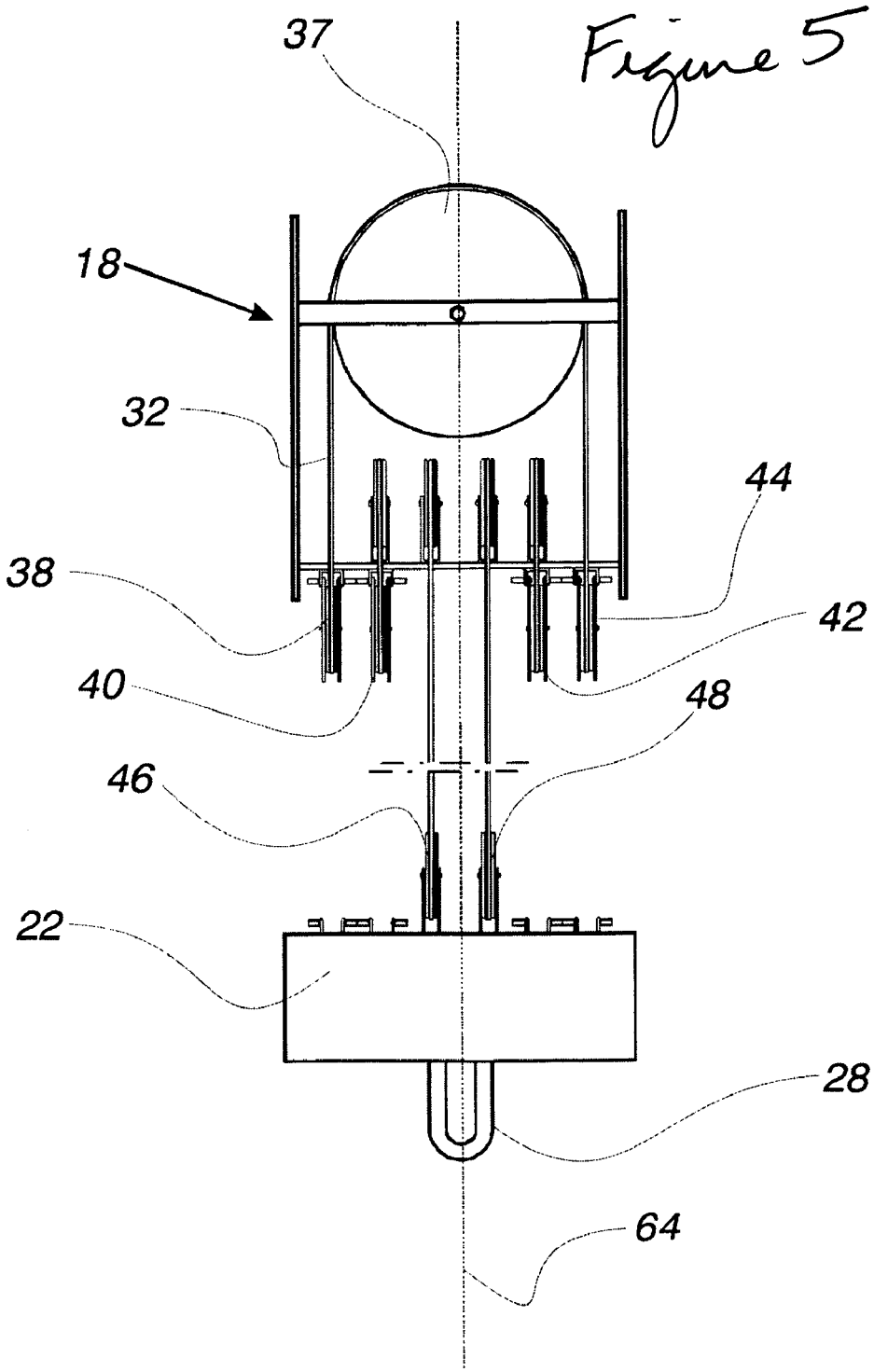
FIG. 5 shows the case where four loose pulleys are attached to the mast head.
Figure 11:
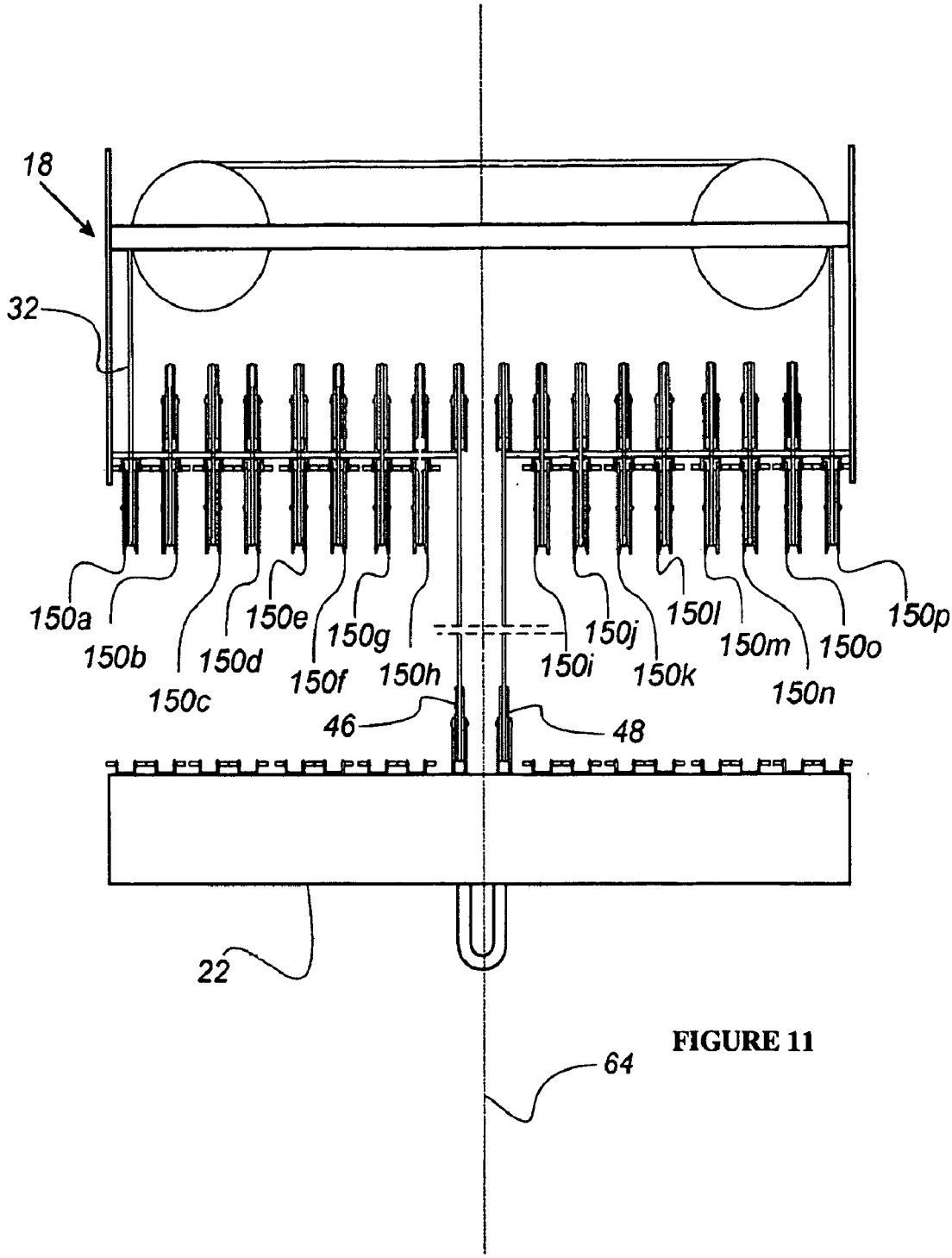
FIG. 11 shows a side view of an embodiment of a splittable block with sixteen loose pulleys.

FIG. 5 shows the case where four loose pulleys 38, 40, 42, and 44 are attached to the mast top side 18 and only two fixed pulleys 46, 48 are attached to trolley 22. That means that only 4 wire parts will extend between the mast top side 18 and the trolley 22. As will be understood, the highest weight can be lifted in the configuration according to FIG. 3, since in that case twelve wire parts extend between the mast top side 18 and the trolley 22. In the configuration according to FIG. 5 relatively little weight can be lifted since only four wire parts extend between the mast top side 18 and the trolley 22. However, now the trolley 22 can be moved at a relatively high speed relative to the mast top side 18. FIG. 11 examples an embodiment wherein sixteen loose pulleys 150*a*, 150*b*, 150*c*, 150*d*, 150*e*, 150*f*, 150*g*, 150*h*, 150*i*, 150*j*, 150*k*, 150*l*, 150*m*, 150*n*, 150*o*, and 150*p* are attached the mast top side 18 and only two fixed pulleys 46, 48 are attached to the trolley 22.

The loose pulleys 38, 40, 42, 44 can be contained in a housing 66. Each housing 66 can further include at least one locking element for attaching the loose pulleys on the trolley 22 and one mast locking element. A hydraulic actuation device 118 can be used for the at least one trolley locking element 68, 70, 72, 74. The locking elements can be a hook or a pin.

It can be seen in FIG. 3, FIG. 4 and FIG. 5 that on the left-hand side of the mast top side 18 exactly the same number of loose pulleys 38, 40, 42, 44 are attached to the mast top side 18 as on the right-hand side. That means that the forces of the hoist cable 32 on the mast will be distributed symmetrically.

Figure 6:
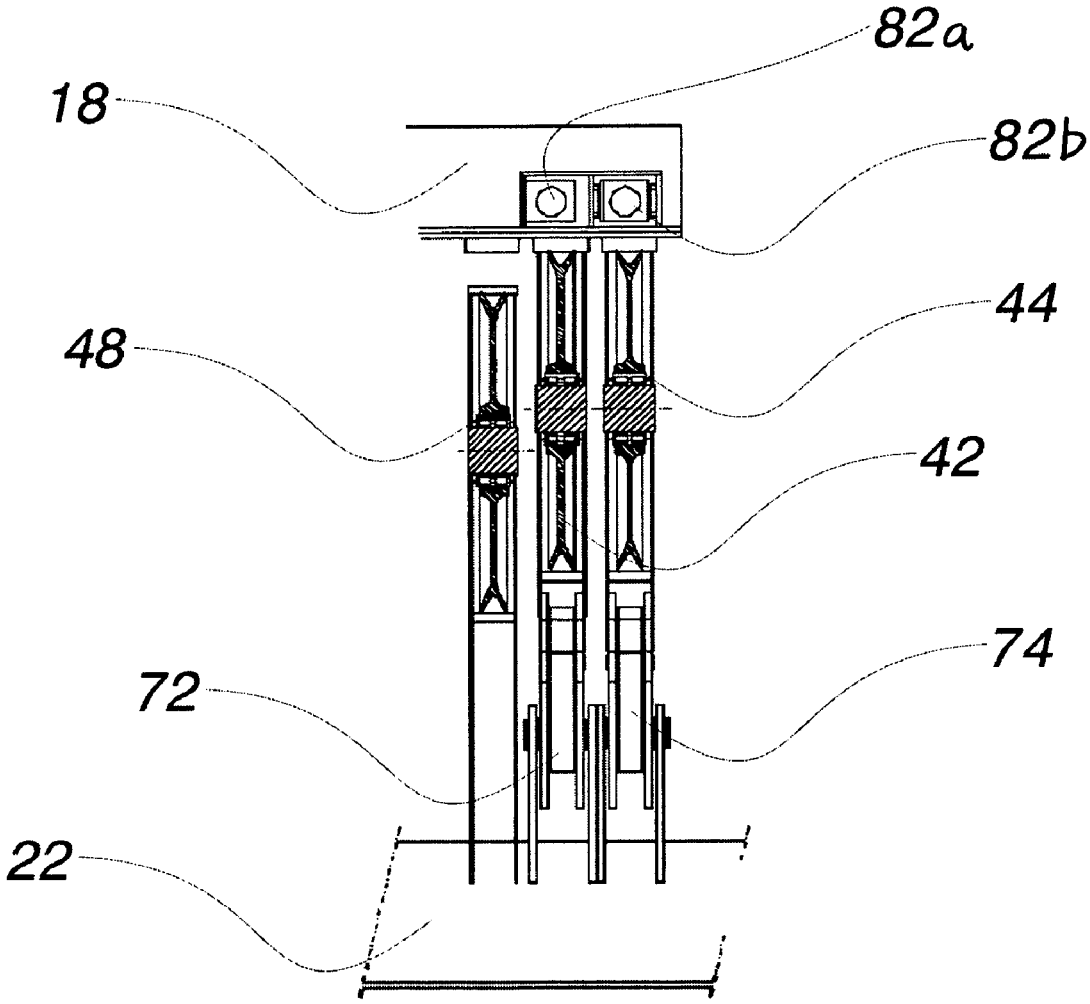
FIG. 6 shows a front view of a possible embodiment of the loose pulleys.

FIG. 6 shows a front view of a part of the trolley 22 with a fixed pulley 48 and loose pulleys 42, 44 thereon. The block will be designed symmetrically, with loose pulleys 42, 44 being placed on both sides of the fixed pulley 48. On the bottom side, the loose pulleys 42, 44 are provided with a trolley locking device. The pulleys 46, 48 can be fixed on the trolley as desired. Since there will always be a certain tension on the hoisting hoist cable 32, the loose pulleys 38, 40, 42, 44 are pulled automatically in the direction of the mast top side 18. For that reason, locking means can be dispensed on the top side of the pulleys 38, 40, 42, and 44. However, if the tension is lost completely, a pulley 38, 40, 42, and 44 will fall downwards by the force of gravity. The hydraulic actuation devices are shown in FIG. 6 as reference numerals 82*a* and 82*b*. In order to be on the safe side, the hoist system is therefore provided with a mast locking device that can be as designed in, for example, FIG. 7.

Figure 7:
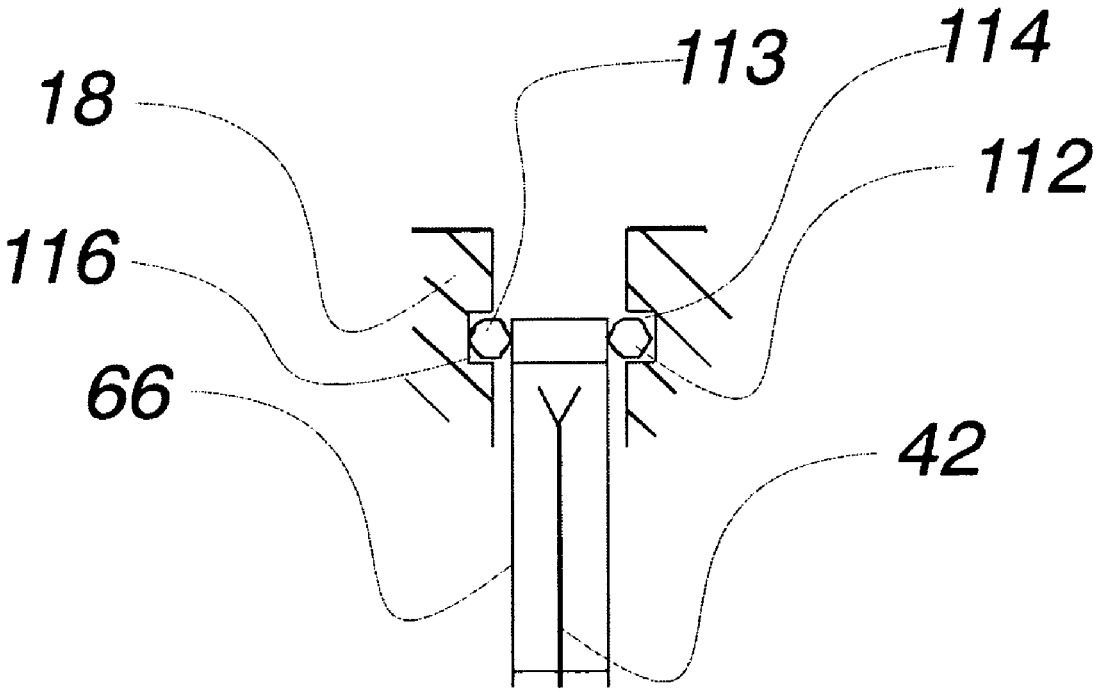
FIG. 7 shows a detailed view of a possible method of connecting the loose pulley to the masthead.

According to FIG. 7, a pulley 42 is provided on its top side with two balls 112, 113 that are connected to the housing 66 of the pulley 42 in such a way that they are movably relative to each other. The balls are accommodated in recesses 114 and 116 in the mast top side 18. If no force at all is exerted upon the pulley 42, the force with which the balls lock the pulley in the mast head is sufficient to hold the pulley 42 in place. However, if a slight force is exerted upon the pulley, the balls are released from the recesses, and the pulley 42 can move downwards.

Figure 8:
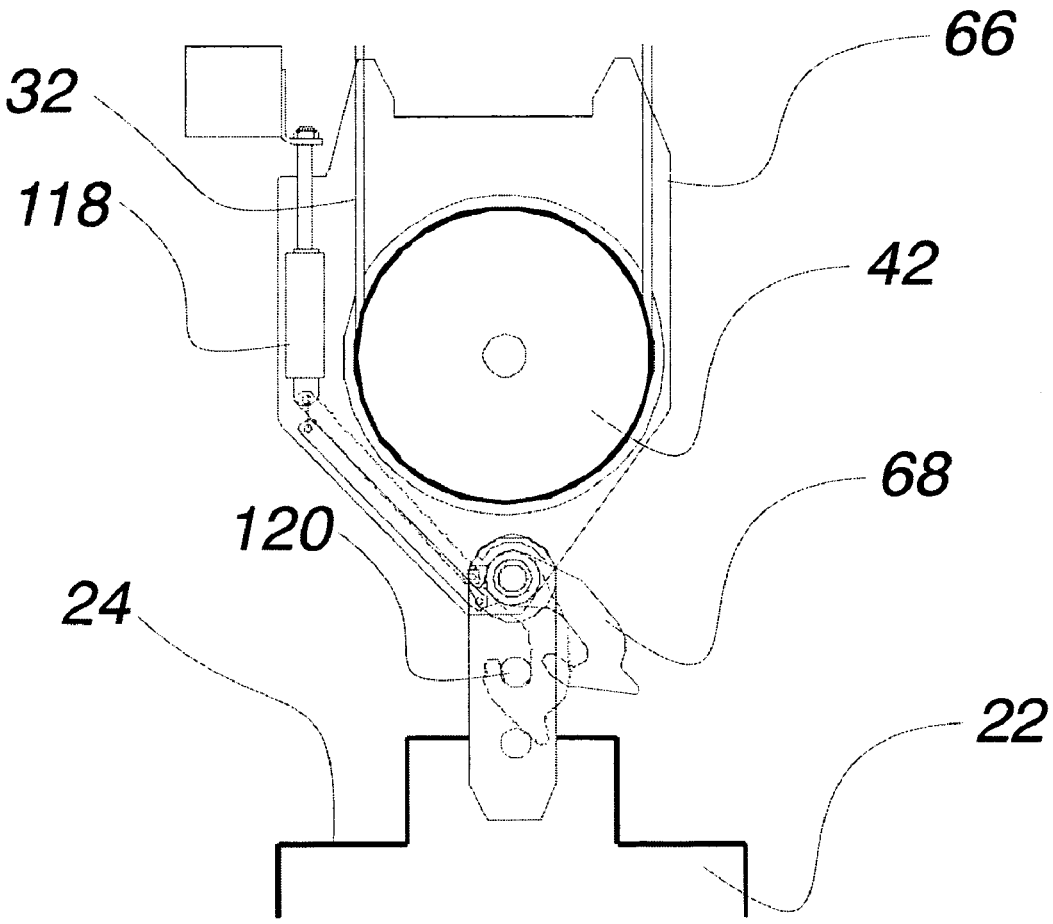
FIG. 8 shows a side view of one of the loose pulleys according to FIG. 7.

FIG. 8 shows a side view of one of the loose pulleys 38, 40, 42, and 44 according to FIG. 7. The lock 68 is shown in two positions. The position of the lock 68 is determined with the aid of a cylinder 118. When the cylinder is not actuated, the lock falls behind the pin 120 during two-blocks pulling see above. The pulley 42 is thus connected to the trolley 22. When the trolley 22 during use is moved relative to the mast top side 18, the trolley 22 takes that loose pulley 42 along with it downwards. If, on the other hand, the cylinder 118 is actuated, the hook cannot grip behind the pin 120 and that means that the trolley 22 cannot take the pulley 42 along with it, so that the pulley 42 remains behind in the mast top side 18.

The cylinder 118 by means of which the lock 120 is operated has been deliberately placed in the mast top side 18. The fact is that the trolley 22 goes into the so-called Hazardous Area on a drilling platform or vessel. During the drilling, gas or oil can escape in this area. Non-explosive equipment must be worked with in the Hazardous Area. For that reason, it has advantages to place the cylinder 118 on/in the mast top side 18 which is in most cases well outside the hazardous zone areas.

Figure 9:
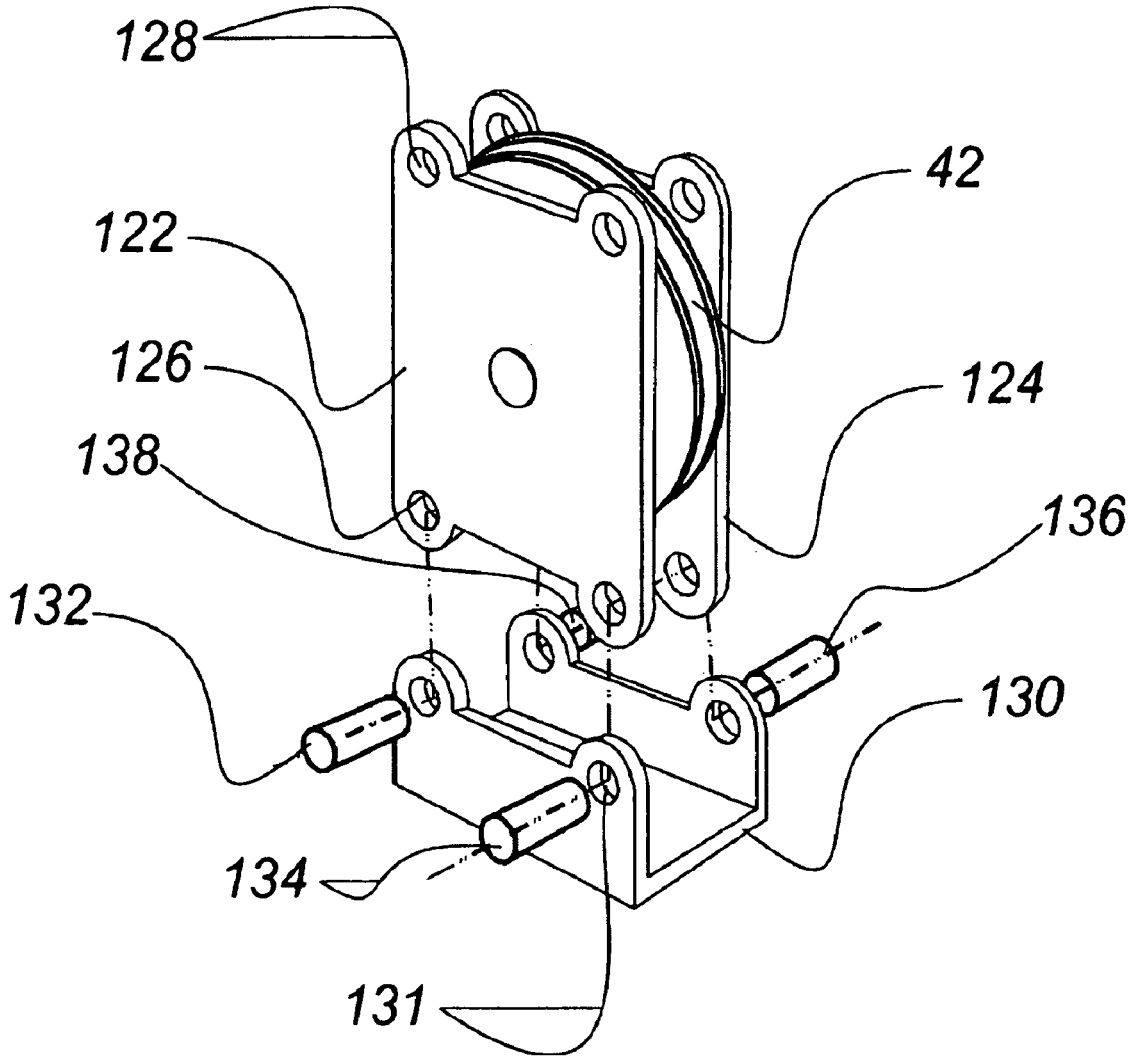
FIG. 9 shows a second embodiment of loose pulley.

FIG. 9 shows a further embodiment of the loose pulley 42 with an outer housing consisting of two plates 122, 124. Both on the top side and on the bottom side, these plates 122, 124 are provided with eyes 126, in which locking pins 132, 134, 136, 138 are received. The locking pins move through eyes 126, which are cut out in, for example, a U-shaped fastening element 130. This fastening element 130 can be attached either to the trolley or to a mast head. In use, the trolley 22 will be hoisted to a position as close as possible to the mast top side 18. After that, either the locking pins 132, 134, 136, 138 belonging to the trolley 22 or the locking pins belonging to the mast top side 18 will be moved into the eyes 126, 128 of the plates 122, 124. In this way a choice can be made concerning which loose pulleys 38, 40, 42, 44 are connected to the mast top side 18 and which loose pulleys 38, 40, 42, 44 are connected to the trolley 22.

Figure 10:
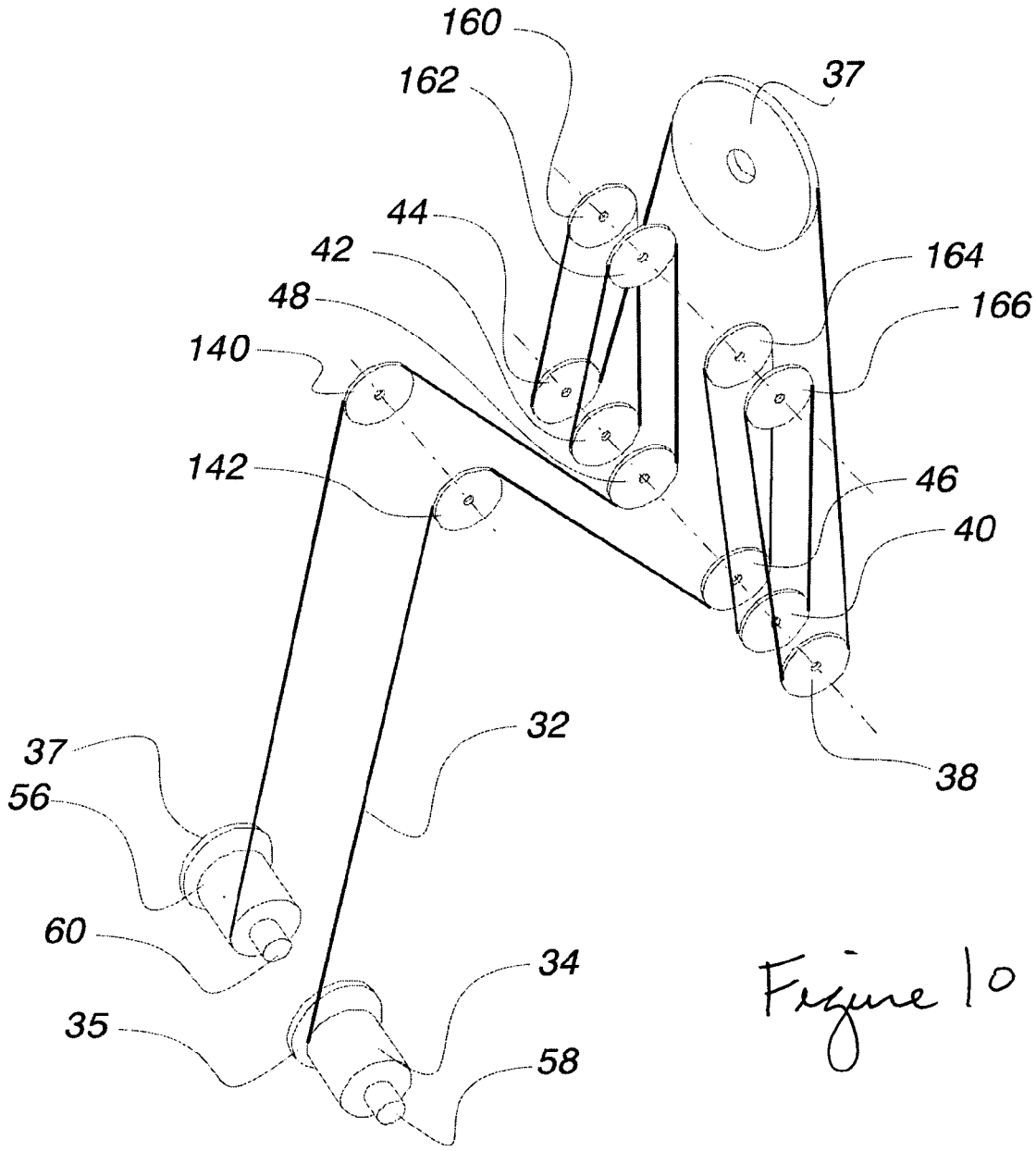
FIG. 10 shows diagrammatically the run of the hoisting cable over the various pulleys, in the case where four loose pulleys are attached to the trolley.

FIG. 10 shows the run of the hoist cable 32 from the hoist cable winch 34 over the successive fixed cable pulleys and loose pulleys on the mast topside and splittable block in the direction of the hoisting winch 56. FIG. 10 shows the case where the four loose pulleys 38, 40, 42, 44 lie substantially in line with the two pulleys 46, 48 that are immovably fixed to the trolley 22. That means that in the case shown in FIG. 10 twelve wire parts will extend between the mast top side 18 and the trolley 10. The hoist system can further include brakes 35, 37 on each winch.

The hoisting cable has a first end and a second end and the first end is wound on the winch and the second end is wound on a second winch. The winch and the second winch are each driven by at least one motor with a low inertia.

Figure 13:
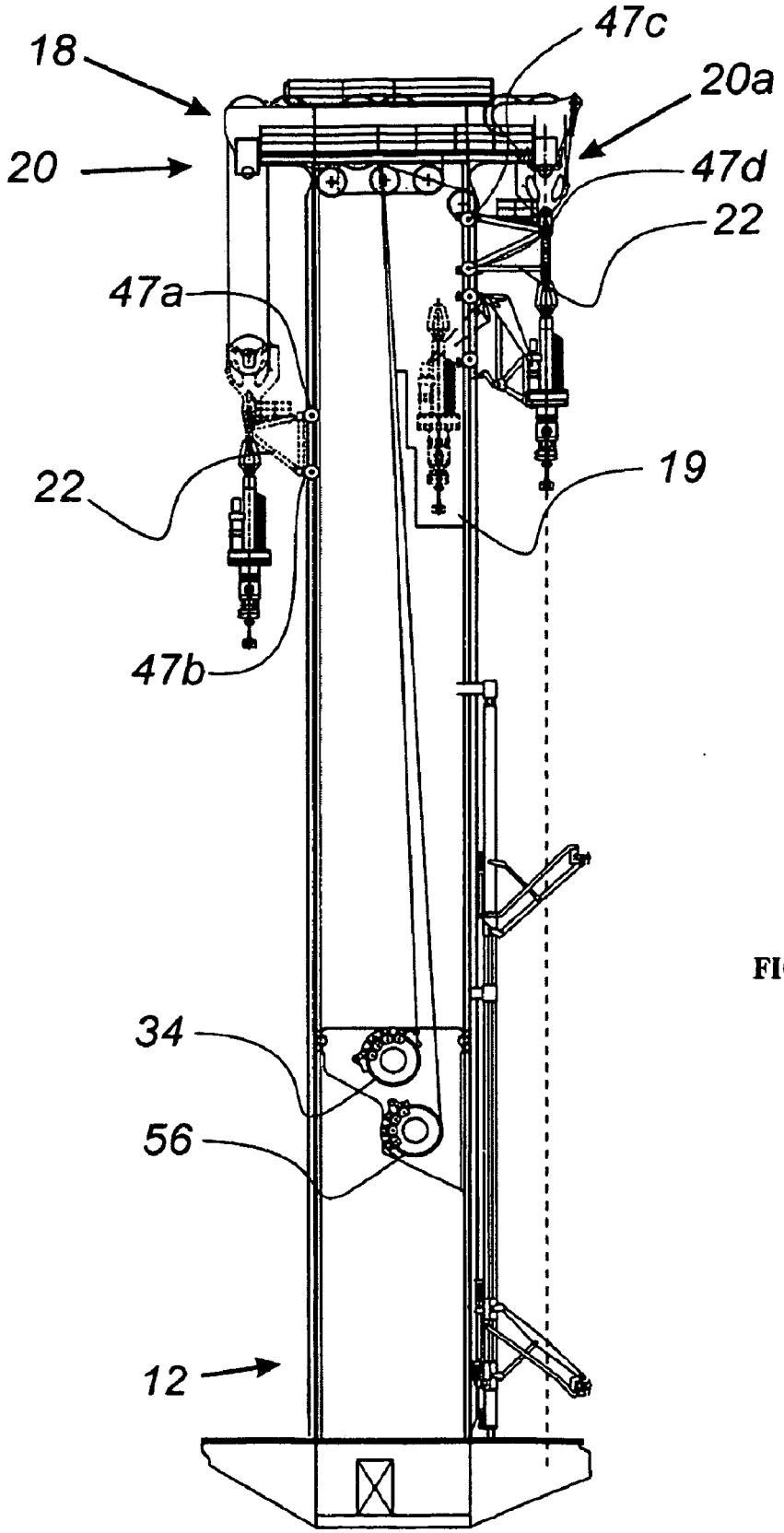
FIG. 13 shows a perspective view of an embodiment of a multipurpose tower with multiple splittable blocks.

The trolley has a base supported by a plurality of wheels 47*a*, 47*b*, 47*c* and 47*d* for slidingly engaging the tubular mast, as exampled in FIG. 13. FIG. 13 examples an embodiment wherein an additional splittable block 20*a* is connected to the tubular mast.

The system can also include numerous rails disposed on the mast's front side. The trolley can then be adapted to engage the rails for lateral movement along the tubular mast.

The gripper, which can also be a hook, can be adapted to support between 10 metric tons and 1000 metric tons.

The invention is also a method for quickly modifying a hoist system from heavy load lifting to light load lifting. The method uses the hoist system of this invention. The method entails disconnecting the heavy load from the gripper, hoisting the trolley to a first position on the mast and disengaging a portion of the loose pulleys from the trolley. The method ends by picking up a lighter load and resuming the hoist system operation.

The above method can also include the step of locking the disengaged loose pulleys to the tubular mast after disengaging a portion of the loose pulleys from the trolley.

The invention is also a method to slip the hoist cable of the hoist system. The method involves stopping the hoist system lifting operations, paying out the hoist cable with the winch, winding the hoist cable with the second winch, thereby transferring the hoist cable from the winch to the second winch, and restarting hoist system lifting operations. The method can also include the step of initiating the paying out step when a preset number of bending reversals for the hoist cable is reached in a particular segment of the hoist cable.

The invention is also a method for quickly modifying a hoist system from light load lifting to heavy load lifting. The method uses the hoist system of this invention. The method entails disconnecting the light load from the gripper, hoisting the trolley to a first position on the mast and disengaging a portion of the loose pulleys from the trolley. The method ends by picking up a heavier load and resuming the hoist system operation.

While this invention has been described with emphasis on the preferred embodiments, it should be understood that within the scope of the appended claims, the invention might be practiced other than as specifically described herein.

What is claimed is:

1. A hoist system for use on a drilling rig, comprising a. a tubular mast comprising:
   i. a mast front side;
   ii. a mast back side; and
   iii. a mast top side;

b. a splittable block connected to the mast top side;

c. a trolley comprising a trolley top side and a trolley bottom side, wherein the trolley top side is connected to the splittable block and wherein the trolley is removably secured on the mast front side;

d. a gripper connected to the trolley bottom side for gripping a load;

e. a hoist cable passing through the splittable block and connected on one end to a hoist cable winch; and f. a hoist cable winch adapted to pull the hoist cable over the mast top side and through the splittable block to move the trolley relative to the tubular mast and lift a load.

2. The hoist system of claim 1, wherein the tubular mast is secured to a floating drilling rig.

3. The hoist system of claim 1, wherein the splittable block comprises a plurality of moveable loose pulleys secured to either the trolley or the tubular mast and a plurality of fixed pulleys secured to the tubular mast.

4. The hoist system of claim 3, wherein the plurality of moveable loose pulley is movable during operation of the hoist system from a first position on the tubular mast to a second position on the trolley.

5. The hoist system of claim 4, further comprising at least one trolley locking element for attaching the loose pulleys on the trolley.

6. The hoist system of claim 5, further comprising a hydraulic actuation device for the at least one trolley locking element.

7. The hoist system of claim 5, wherein the at least one trolley locking elements are at least one hook.

8. The hoist system of claim 5, wherein the at least one trolley locking elements are at least one pin.

9. The hoist system of claim 4, further comprising at least one mast locking element for attaching the loose pulleys to the tubular mast.

10. The hoist system of claim 9, further comprising a hydraulic actuation device for the at least one mast locking element.

11. The hoist system of claim 3, wherein the tubular mast has a central axis and the loose pulleys are attached symmetrically on the tubular mast relative to the central axis.

12. The hoist system of claim 3, further comprising a housing for containing the loose pulleys.

13. The hoist system of claim 3, comprising between two loose pulleys and sixteen loose pulleys.

14. The hoist system of claim 3, comprising between two fixed pulleys and eight fixed pulleys.

15. The hoist system of claim 1, wherein the tubular mast has at least one opening in the front side.

16. The hoist system of claim 1, wherein the hoisting cable comprises a first end and a second end and the first end is wound on the hoist cable winch and the second end is wound on a second winch.

17. The hoist system according to claim 16, wherein the hoist cable winch and the second winch are each driven by at least one motor with a low inertia.

18. The hoist system of claim 1, wherein the tubular mast has a height between 30 feet and 240 feet.

19. The hoist system of claim 1, wherein the tubular mast has a diameter between 3 feet and 30 feet.

20. The hoist system of claim 1, wherein the tubular mast has a shape selected from the group consisting of rectangular, square, triangular, and other angular shapes.

21. The hoist system of claim 1, wherein the tubular mast is partially solid.

22. The hoist system of claim 1, further comprising a plurality of rails disposed on the mast front side and the trolley is adapted to engage the rails for lateral movement along the tubular mast.

23. The hoist system of claim 1, further comprising at least two additional splittable blocks connected to the tubular mast.

24. The hoist system of claim 1, wherein the trolley comprises a base supported by a plurality of wheels for slidingly engaging the tubular mast.

25. The hoist system of claim 1 wherein the gripper is adapted to support between 10 metric tons and 1000 metric tons.

26. The hoist system of claim 1, wherein the gripper is a hook.

27. The hoist system of claim 1, wherein the hoist cable has a diameter ranging between 0.5 inches and 3 inches and is adapted to support a load of between 1 metric tons and 100 metric tons.

28. The hoist system of claim 1, further comprising a brake on the hoist cable winch.

29. The hoist system of claim 1, further comprising a control system for monitoring and moving the hoist cable, the hoist cable winch, the splittable block, and the trolley.

30. A hoist system for use in casing drilling comprising:

a. a tubular mast comprising:
   i. a mast top side with a mast opening disposed therein;
   ii. a mast back side; and
   iii. a mast front side;

b. a splittable block connected to the mast top side, having a splittable block opening aligned with the mast opening;

c. a trolley comprising a trolley top side and a trolley bottom side, wherein the trolley top side is connected to the splittable block having a trolley opening disposed in the trolley from the trolley top side through to the trolley bottom side and aligned with the splittable block opening;

d. a gripper connected to the trolley bottom side for gripping a load;

e. a hoist cable passing through the splittable block and connected on one end to a hoist cable winch;

f. a wire line passing through the mast opening, the splittable block opening, and the trolley opening and connected on a first end to a wire winch;

g. the hoist cable winch is adapted to pull the hoist cable over the mast top side and through the splittable block to move the trolley relative to the tubular mast and lift a load; and h. the wire winch is adapted to pull the wire line over the mast top side and through the openings for lifting casing drilling equipment.

31. The hoist system of claim 30, wherein the tubular mast is secured to a floating drilling rig.

32. The hoist system of claim 30, wherein the splittable block comprises a plurality of moveable loose pulleys secured to either the trolley or the tubular mast and a plurality of fixed pulleys secured to the tubular mast.

33. The hoist system of claim 32, wherein the plurality of moveable loose pulley is movable during operation of the hoist system from a first position on the tubular mast to a second position on the trolley.

34. The hoist system of claim 33, further comprising at least one trolley locking element for attaching the loose pulleys on the trolley.

35. The hoist system of claim 34, further comprising a hydraulic actuation device for the at least one trolley locking element.

36. The hoist system of claim 35, wherein the at least one trolley locking elements are at least one hook.

37. The hoist system of claim 35, wherein the at least one trolley locking elements are at least one pin.

38. The hoist system of claim 33, further comprising at least one mast locking element for attaching the loose pulleys to the tubular mast.

39. The hoist system of claim 38, further comprising a hydraulic actuation device for the at least one mast locking element.

40. The hoist system of claim 32, wherein the tubular mast has a central axis and the loose pulleys are attached symmetrically on the tubular mast relative to the central axis.

41. The hoist system of claim 32, further comprising a housing for containing the loose pulleys.

42. The hoist system of claim 32, comprising between two loose pulleys and sixteen loose pulleys.

43. The hoist system of claim 32, comprising between two fixed pulleys and eight fixed pulleys.

44. The hoist system of claim 30, wherein the tubular mast has at least one opening in the mast front side.

45. The hoist system of claim 30, wherein the hoisting cable comprises a first end and a second end and the first end is wound on the hoist cable winch and the second end is wound on a second winch.

46. The hoist system according to claim 45, wherein the hoist cable winch and the second winch are each driven by at least one motor with a low inertia.

47. The hoist system of claim 30, wherein the tubular mast has a height between 30 feet and 240 feet.

48. The hoist system of claim 30, wherein the tubular mast has a diameter between 3 feet and 30 feet.

49. The hoist system of claim 30, wherein the tubular mast has a shape selected from the group consisting of rectangular, square, circular, and triangular.

50. The hoist system of claim 30, wherein the tubular mast is partially solid.

51. The hoist system of claim 30, further comprising a plurality of rails disposed on the mast front side and the trolley is adapted to engage the rails for lateral movement along the tubular mast.

52. The hoist system of claim 30, further comprising at least two additional splittable blocks connected to the tubular mast.

53. The hoist system of claim 30, wherein the trolley comprises a base supported by a plurality of wheels for slidingly engaging the tubular mast.

54. The hoist system of claim 30, wherein the gripper is adapted to support between 10 metric tons and 1000 metric tons.

55. The hoist system of claim 30, wherein the gripper is a hook.

56. The hoist system of claim 30, wherein the hoist cable has a diameter ranging between 0.5 inches and 3 inches and is adapted to support a load of between 1 metric tons and 1000 metric tons.

57. The hoist system of claim 30, further comprising a brake on the hoist cable winch.

58. The hoist system of claim 30, further comprising a control system for monitoring and moving the hoist cable, the hoist cable winch, the splittable block, and the trolley.

59. A method for quickly modifying a hoist system from heavy load lifting to light load lifting comprising the steps:

a. using a hoist system comprising:
   i. a tubular mast comprising:
      1. a mast front side;
      2. a mast back side; and
      3. a mast top side;
   ii. a splittable block connected to the mast top side;
   iii. a trolley comprising a trolley top side and a trolley bottom side, wherein the trolley top side is connected to the splittable block and wherein the trolley is removably secured on the mast front side;
   iv. a gripper connected to the trolley bottom side for gripping a load;
   v. a hoist cable passing through the splittable block and connected on one end to a hoist cable winch; and
   vi. a hoist cable winch adapted to pull the hoist cable over the mast top side and through the splittable block to move the trolley relative to the tubular mast and lift a load;

b. disconnecting the heavy load from the gripper;

c. hoisting the trolley to a first position on the mast above a uppermost lifting position;

d. disengaging a portion of loose pulleys from the trolley;
e. picking up a lighter load; and
f. resuming the hoist system operation.

60. The method of claim 59, further comprising the step of after disengaging a portion of the loose pulleys from the trolley locking the disengaged loose pulleys to the tubular mast.

61. The method of claim 59, further comprising the step of using the hoist system for case drilling.

62. A method to slip the hoist cable of the hoist system comprising the steps of:

a. using a hoist system comprising:
  i. a tubular mast comprising:
    1. a mast front side;
    2. a mast back side; and
    3. a mast top side;
  ii. a splittable block connected to the mast top side;
  iii. a trolley comprising a trolley top side and a trolley bottom side, wherein the trolley top side is connected to the splittable block, wherein the trolley is removably secured on the mast front side;
  iv. a gripper connected to the trolley bottom side for gripping a load;
  v. a hoist cable passing through the splittable block and connected on one end to a hoist cable winch; and
  vi. a hoist cable winch adapted to pull the hoist cable over the mast top side and through the splittable block to move the trolley relative to the tubular mast and lift a load;
b. stopping the hoist system lifting operations;
c. paying out the hoist cable with the winch;
d. winding the hoist cable with a second winch; thereby transferring the hoist cable from the winch to the second winch; and
e. restarting hoist system lifting operations.

63. The method of claim 62, further comprising the step of initiating the paying out step when a preset number of bending reversals for the hoist cable is reached in a particular segment of the hoist cable.

64. The method of claim 62, further comprising the step of using the hoist system for case drilling.

65. A method for quickly modifying a hoist system from light load lifting to heavy load lifting comprising the steps:

a. using a hoist system comprising:
  i. a tubular mast comprising:
    1. a mast front side;
    2. a mast back side; and
    3. a mast top side;
  ii. a splittable block connected to the mast top side;
  iii. a trolley comprising a trolley top side and a trolley bottom side, wherein the trolley top side is connected to the splittable block and wherein the trolley is removably secured on the mast front side;
  iv. a gripper connected to the trolley bottom side for gripping a load;
  v. a hoist cable passing through the splittable block and connected on one end to a hoist cable winch; and
  vi. a hoist cable winch adapted to pull the hoist cable over the mast top side and through the splittable block to move the trolley relative to the tubular mast and lift a load;
b. disconnecting a light load from the gripper;
c. hoisting the trolley to a first position on the mast above a uppermost lifting position;
d. engaging a portion of loose pulleys with the trolley;
e. picking up a heavier load, and
f. resuming the hoist system operation.

66. The method of claim 65, further comprising the step of using the hoist system for case drilling.

* * * * *